United States Patent [19]

Lockwood

[11] Patent Number: 4,916,867

[45] Date of Patent: Apr. 17, 1990

[54] DRILL BIT SHARPENER

[76] Inventor: David N. Lockwood, 6191 Ewart St., Burnaby, B.C., Canada, V5J 2X4

[21] Appl. No.: 286,621

[22] Filed: Dec. 19, 1988

[51] Int. Cl.[4] ..... B24B 3/28

[52] U.S. Cl. ..... 51/96; 51/124 R; 51/219 R; 279/84

[58] Field of Search ..... 51/96, 124 R, 219 R, 51/219 PC; 269/57, 130, 131, 132, 189, 249; 279/76, 84

[56] References Cited

U.S. PATENT DOCUMENTS

| | | | |
|---|---|---|---|
| 791,115 | 5/1905 | Stephens | 279/84 |
| 3,703,055 | 11/1972 | Niquet | 51/219 R |
| 4,059,928 | 11/1972 | Marchitello | 51/219 R X |
| 4,520,599 | 6/1985 | Slinsky | 51/219 R |
| 4,848,036 | 7/1989 | Kiso | 51/219 R X |

FOREIGN PATENT DOCUMENTS

| | | | |
|---|---|---|---|
| 3039649 | 5/1982 | Fed. Rep. of Germany | 51/219 R |
| 124557 | 7/1984 | Japan | 51/219 R |

*Primary Examiner*—Robert P. Olszewski
*Attorney, Agent, or Firm*—Jean-Pierre Fortin

[57] ABSTRACT

The present invention provides a drill bit sharpening device, for use with a support carrying a rotatable grindstone and having pivot arm retaining means. The device comprises a drill bit jig having clamp means for releasably retaining a drill bit therein in a position wherein the drill bit axis extends forward from the clamp means along a corresponding clamp axis. The clamp means has a first and second opposed jaw movable toward and away from one another so as to accommodate different diameter drill bits positioned therebetween. A jaw adjuster connected to the first jaw has a U-shaped frame with upper and lower threaded flanges extending over the second jaw. A nut adapted to mate with the threaded flanges is provided for securing the drill bit. A retaining guide is connected to the second jaw and is adapted to urge the second jaw away from the first one. A first and second jig pivot arm is connected to the first and second jaw and symmetrically located about the axis of the drill bit such that if the clamp means is rotated 180° about its axis the arms will assume identical and diametrically opposed positions. The pivot arms are located such that the first pivot arm can rest in a pivot arm retaining means with the axis of the drill bit held in the clamp extending forward to intersect a grinding face of said grindstone carried in the support at a predetermined angle $A_1$ thereto, and in an inverted clamp position the second arm can rest in a pivot arm retaining means with the axis of the drill bit held in the clamp extending forwardly to intersect the same grinding face at an identical point of intersection on the drill bit axis and at an equal angle $A_2$.

48 Claims, 3 Drawing Sheets

DRILL BIT SHARPENER

FIELD OF THE INVENTION

This invention relates to a device for sharpening tools, and more particularly to a device for sharpening drill bits.

DESCRIPTION OF THE PRIOR ART

U.S. Pat. No. 4,658,549 which issued to applicant, describes the problems associated with the proper sharpening of drill bits to their original parameters. This was found to be quite difficult especially when the tip of a drill bit is manually held against the face of a grindstone. Clamping devices which require the use of micrometers or other fine adjusting means have been developed, but generally they have been inadequate in accurately sharpening the tip to obtain all of the original parameters of the cutting edges. In addition, these devices tend to be relatively complex in construction, in particular in the provision of fine adjusting mechanisms for the positioning of the drill bit, and hence relatively expensive to manufacture, as well as relatively tedious to use.

In the above referenced patent, there is disclosed a sharpening device which will sharpen drill bits, be relatively simple to construct, and still allow all of the original parameters to be obtained in the resharpened drill bit, while at the same time being relatively simple to use.

SUMMARY OF THE INVENTION

In the present invention, the drill bit sharpening device provides an improved jaw and jaw adjuster arrangement which simplifies the construction of the device while improving retention of the drill bit. In addition, the improved jaws do not obstruct the pivot arms thereby permitting smaller distances between the grindstone face and the axis of the pivot arms when sharpening small diameter drill bits. Also, the pivot arm and support arrangement provide a variable offset distance between the pivot axis and the clamp axis to allow the material behind the cutting edge of drill bits to be accurately sloped when sharpening bits of different size.

In particular, the present invention provides a drill bit sharpening device, for use with a support carrying a rotatable grindstone and having pivot arm retaining means. The device comprises a drill bit jig having clamp means for releasably retaining a drill bit therein in a position wherein the drill bit axis extends forward from the clamp means along a corresponding clamp axis. The clamp means has a first and second opposed jaw movable toward and away from one another so as to accommodate different diameter drill bits positioned therebetween. A jaw adjuster connected to the first jaw has a U-shaped frame with upper and lower threaded flanges extending over the second jaw. A nut adapted to mate with the threaded flanges is provided for securing the drill bit. A retaining guide is connected to the second jaw and is adapted to urge the second jaw away from the first one. A first and second jig pivot arm is connected to the first and second jaw and symmetrically located about the axis of the drill bit such that if the clamp means is rotated 180° about its axis the arms will assume identical and diametrically opposed positions. The pivot arms are located such that the first pivot arm can rest in a pivot arm retaining means with the axis of the drill bit held in the clamp extending forward to intersect a grinding face of said grindstone carried in the support at a predetermined angle $A_1$ thereto, and in an inverted clamp position the second arm can rest in a pivot arm retaining means, with the axis of the drill bit held in the clamp extending forwardly to intersect the same grinding face at an identical point of intersection on the drill bit axis and at an equal angle $A_2$.

The sharpening device can also include the support, which can usefully be provided with a grindstone mount to rotatably support a circular grindstone at a grindstone axis, which grindstone axis may usefully be laterally spaced from and parallel to the jig pivot axis.

In one embodiment of the invention, the jig pivot arm comprises a first and second sleeve each having a bore with an axis eccentrically located in relation to the main axis of the sleeve. With this arrangement, the vertical distance between the axes of the sleeve and the clamp is equal to an offset $D_1$ and the vertical distance between the axes of the bore and the clamp is equal to an offset $D_2$. Accordingly, a support shaft is used as a pivot arm retaining means, when the bore is used as a jig pivot arm, and a support sleeve is used as a pivot arm retaining means when the sleeve of the clamp is used as a jig pivot arm. The support sleeve has an interior diameter larger than the exterior diameter of the pivot arm sleeve.

DRAWINGS

The embodiments of the invention in which an exclusive property or privilege is claimed will be defined as follows:

FIG. 1 is perspective view of a partially assembled embodiment of the improved drill bit sharpening device of the present invention;

FIG. *2a* is a sectional view of a bit retaining jaw taken along lines *2a—2a* of FIG. *2b;*

FIG. *2b* is a side view of a bit retaining jaw;

FIG. *2c* is a plan view thereof;

DESCRIPTION OF THE PREFERRED EMBODIMENTS

Prior to describing the embodiments of the invention shown in the Figures, it should be noted that the terms "upward", "downward", "sideways", and similar terms are used in a relative, rather than absolute sense. Such terms are absolute only with reference to a typical position in which the device of the present invention might be used.

Figure 1:
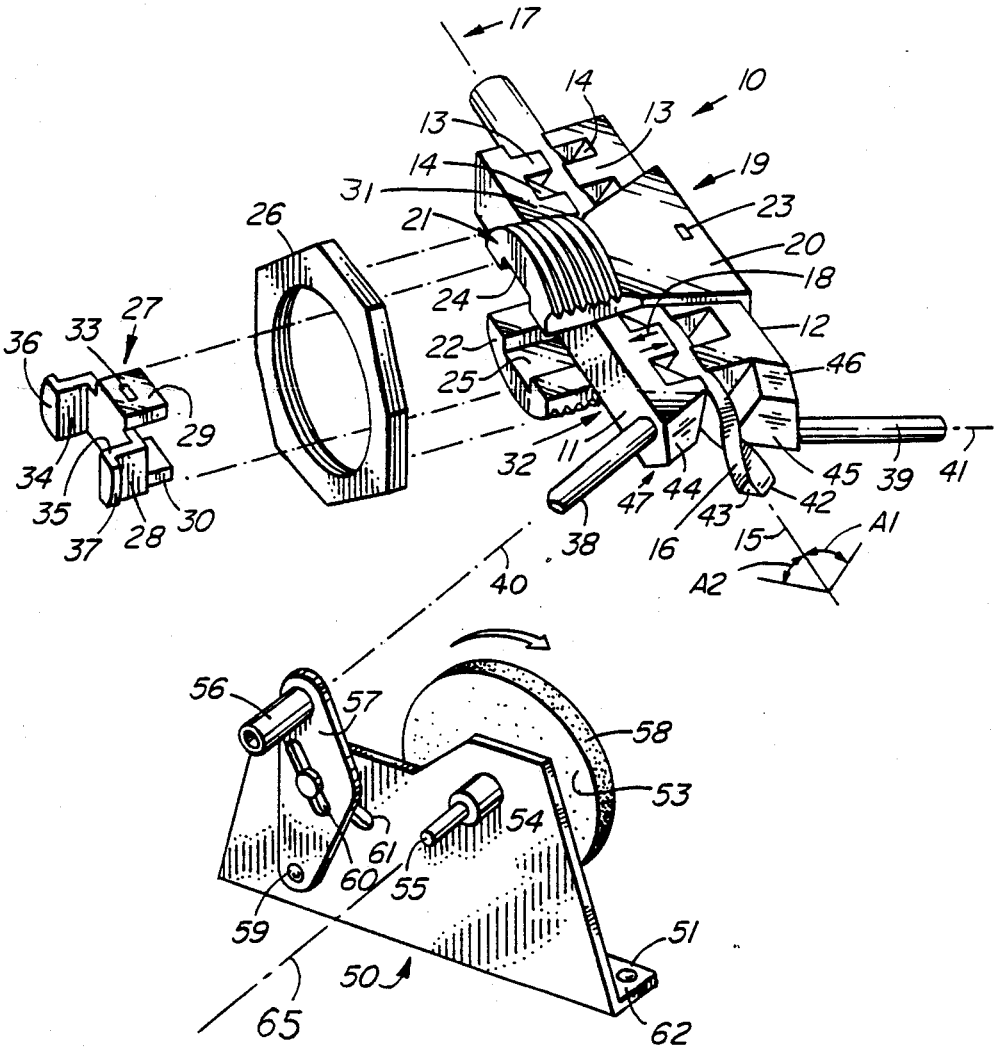
Figure 2B:
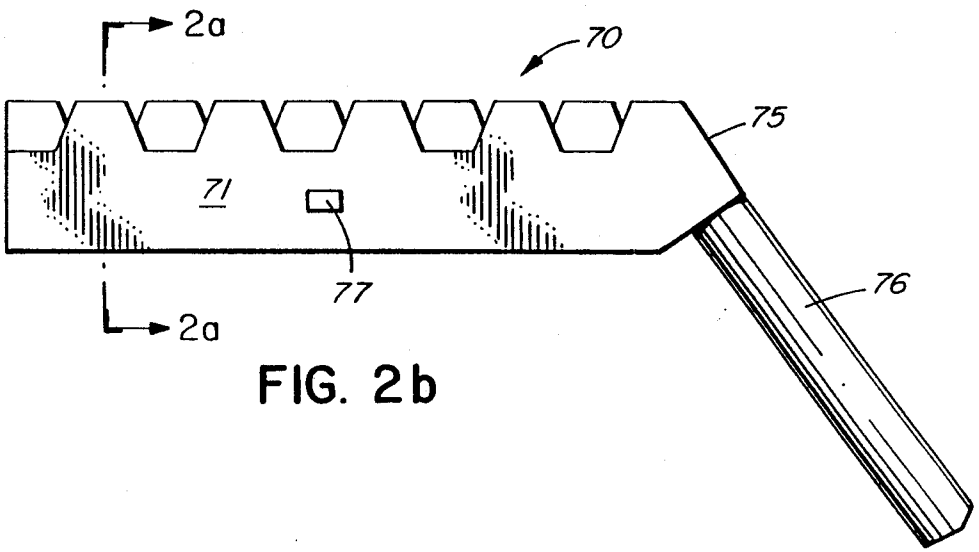

Referring now to the first embodiment of the invention as shown in FIG. 1, the device shown consist of a jig 10, and a support 50, which are not attached to one another, but are typically used in conjunction with one another. The jig 10 has two elongated, opposed jaws 11 and 12, each carrying alternately sloped symmetrical sets of meshing teeth 13 and 14. Jaws 11 and 12 are aligned such that when a drill bit 16 is held therebetween, the axis of the drill bit will coincide with clamp axis 17 as clearly shown in FIG. 1 and FIG. 4. The shape of teeth 13 and 14, and their alternating arrangement across the jaws (as best shown in FIG. 2), ensures that even when smaller drill bits are utilized, the two axes will coincide. Jaws 11 and 12 can be urged toward and away from one another in direction of arrows 18, so as to retain drill bit 16 therebetween, by means of jaw adjuster 19. Jaw adjuster 19 consists of a U-shaped bracket 20 having upper and lower threaded flanges 21 and 22 respectively. Flanges 21 and 22 extend over jaw 11 and 12 and are connected to jaw 12, by means of a lug arrangement 23, or the like. Flanges 21 and 22 are each provide with a rectangular shaped channel 24 and 25 respectively. A nut 26, sized to match the threaded flanges, is adapted to be positioned between a retaining guide 27 and jaw 11.

Retaining guide 27 consist of a bracket 28 having an upper and lower guiding arm 29 and 30 respectively, each adapted to be connected to side 31 and 32 of jaw 21, by means of a lug arrangement 33 or the like. The upper guiding arm 29 provides a sliding fit in upper rectangular channel 24, whereas lower guiding arm 30 provides a sliding fit in lower rectangular channel 25. Bracket 28 is further comprised of a first and second retaining arm 34 and 35, each having a retaining tab 36 and 37 (respectively. Each tab extend laterally from the retaining arms to retain nut 26 between guide 27 and jaw 11. Accordingly, when tightened, nut 26 and bracket 20 will move toward one another and nut 26 will abut against jaw 11 to urge drill bit 16 against jaw 12. When loosened, nut 26 and bracket 20 will move away from one another and nut 26 will abut retaining tabs 26 and 37 to urge jaw 11 away from the drill bit and jaw 12. Nut 26 abuts jaw 11 near each end of jaw 11 to uniformly distribute the pressure of jaw 11 substantially against the length of the drill bit 16.

The jig pivoting assembly consist of a first pivot arm 38 connected at the forward end of jaw 11, and a second pivot arm 39 also connected at the forward end of jaw 12. The first and second pivot arms are symmetrically located about the axis 15 of drill bit 16 such that if jit 10 is rotated 180° about axis 17, the pivot arms will assume identical and diametrically opposed positions. Each pivot arm is comprised of a shaft disposed such that the lateral angle $A_1$ between axis 40 of pivot arm 38 and axis 15 is equal but opposite to the lateral angle $A_2$ between axis 41 of pivot arm 39 and axis 15.

Referring now to support 50, such support is provided with a base 51 which gives stability to support 50 at right angles to the grindstone rotational axis 65. A side wall 52 extends vertically from base 51 and is used as a grindstone mount. A grindstone 53 is mounted to side wall 52 by means of a sleeve 54 secured thereto, sleeve 54 adds stability to support 50 parallel to the grindstone rotational axis 65 when the driver device rests on a common base with support 50 and is connected to driven shaft 55. Support base 50 is conveniently provided with holes 62 for attachment to a common base with the driver, while sleeve 54 maintains proper alignment of the driver. Sleeve 54 holds driven shaft 55 of grindstone 53, parallel to sleeve 56 of bracket 57 providing accurate alignment between the pivot axis 40 and the grindstone rotational axis 65. Adjustment of the distance between the pivot axis 40 and the grindstone face 58 is obtained by rotating bracket 57 about pivot point 59. A wing nut and bolt arrangement 60 is provided to secure bracket 57 at a preferred position along slot 61. In operation, shaft 38 is inserted sufficiently into support sleeve 56 to enable the tip of drill bit 16 to be positioned against the face 58 of grindstone 53. Once properly positioned, face 42 of the tip of drill bit 16 can be sharpened. Similarly, jig 10 can be inverted, and shaft 39 inserted into sleeve 56 to allow the sharpening of face 43 of drill bit 16. In this embodiment, jaws 11 and 12 are provided with sloping faces 44 and 45 respectively and bevels 47, to facilitate the sharpening of smaller diameter drill bits. Since most smaller diameter drill bits require greater curvature on faces 42 and 43, jig-10 must be positioned closer against the face 58 of grindstone 53 to provide closer positioning. Faces 44 and 45 can be sloped to parallel the pivot arm on their respective jaw, and have excess material removed by bevel 47. Support 50 may also be conveniently used to sharpen other tools such as chisels and the like by inserting a solid shaft into sleeve 56 to provide a tool rest.

Figure 2C:
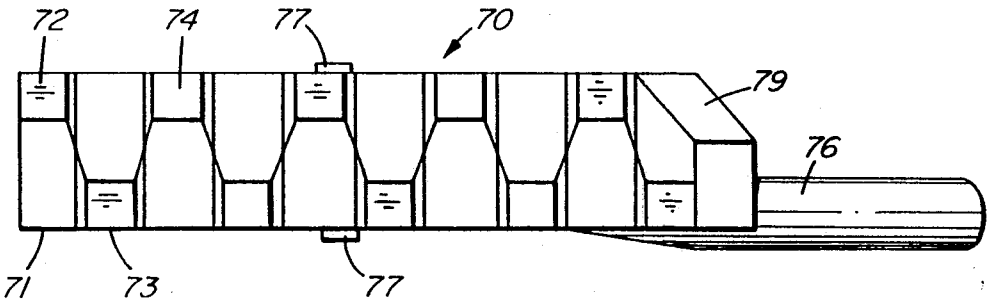
Figure 2A:
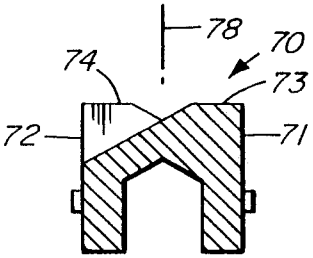
Figure 3:
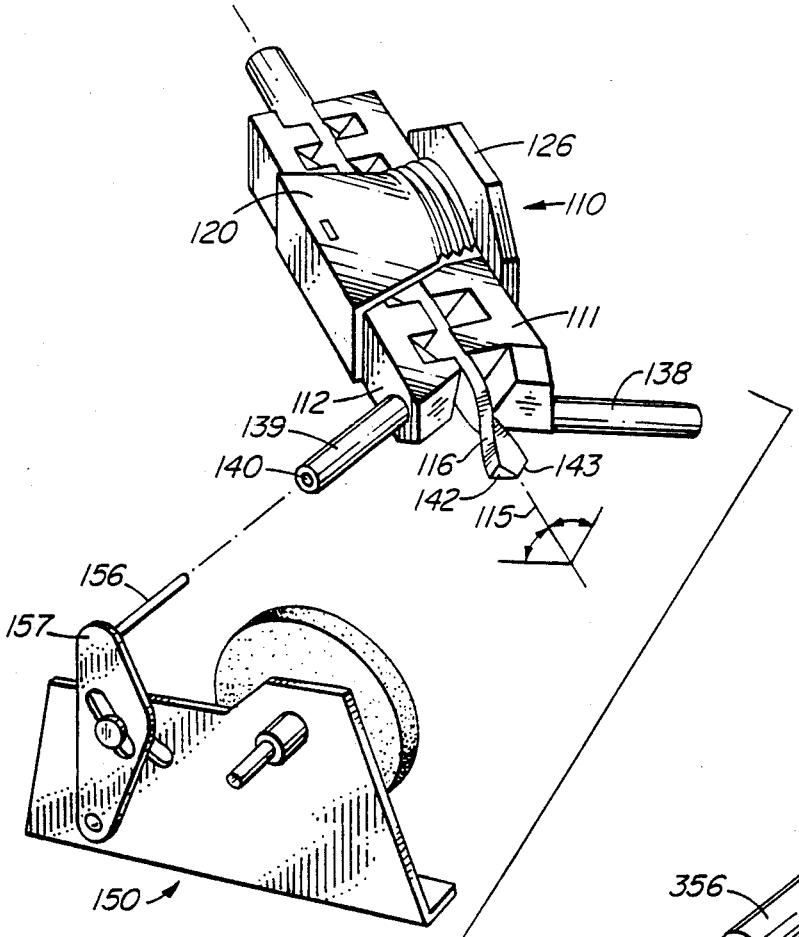
FIG. 3 is a perspective view of another embodiment of the invention with the drill bit sharpening device in the inverted position.

Referring now to FIGS. 2*a* and 2*c*, the retaining jaw shown in these figures consist of an elongated member 70 having straight side edges 71 and 72. Each jaw is provide with alternately sloped symmetrical sets of meshing teeth 73 and 74. For example, tooth 73 is sloped downwardly toward side edge 72 and tooth 74 is sloped downwardly toward side edge 71. The sloped parts of the teeth beyond the point of contact with the maximum sized drill bit may conveniently be rounded or flattened as shown. These sloped teeth mesh with the teeth of an adjacent jaw in which the teeth are oppositely sloped to center a drill bit along the clamp axis as shown in FIGS. 1 and 3. This permits each of the jaws to be identically constructed, and ensures that even when smaller drill bits are utilized, the axis of the drill bit and the clamp axis 78 will coincide. As indicated above, each jaw is provided with a sloped forward face 75 which is parallel to pivot a shaft 76 and has a bevel 79. This facilitates the sharpening of smaller diameter drill bits since a minimum distance is maintain between the axis of the pivot arms and the grindstone face. A lug arrangement 77 or the like is used to secure the first jaw 11 to retaining guide 27 and the second jaw 12 to U-shaped bracket 19 as clearly shown in FIG. 1.

Referring now to FIG. 3, the drill bit sharpening device is shown in the inverted position for sharpening the opposite face a drill bit. In this figure, the jig 110 is shown assembled with nut 126 securely fastened to U-shaped bracket 120. However, in this embodiment, first and second jaw 111 and 112 are provided with pivot arms comprised of sleeves 138 and 139 respectively, each provided with a bore 140 centrally located therein. The jig 110 is supported on grindstone mount 150 by means of a support bracket 157 having a support shaft 156. In operation, jig 110 would be supported on mount 150 by inserting shaft 156 into bore 140 of sleeve 138 or 139 to permit the sharpening of face 142 and 143 of drill bit 116.

Figure 5:
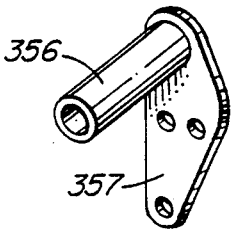
FIG. 5 is a perspective view of a pivot arm retaining means for use with the embodiment of FIGS. 3 and 4.
Figure 4:
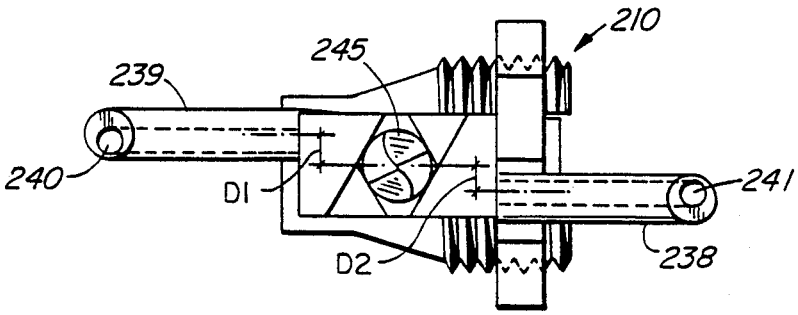
FIG. 4 is a front elevation view of a jig assembly according to an another embodiment of the invention.

FIG. 4 shows a front elevation view of the jig assembly according to another embodiment of the invention. In this embodiment, the jig assembly 210 is provided with sleeves 238 and 239 which are similar to those in the embodiment of FIG. 3, except that bore 240 and 241 have their central axis eccentrically located with respect to the central axes of sleeves 238 and 239. Offset $D_1$ represents the vertical distance between the central axes of sleeves 238 and 239, and the clamp axis or drill bit axis more clearly shown in FIG. 3. Offset $D_2$ represents the vertical distance between the central axes of bores 240 and 241, and the same clamp axis. This offset, in part, determines the backsweep angle behind the cutting edge of the drill bit. In order to obtain the backsweep curve and angle there must be a vertical separation between the jig pivot axis and the clamp axis. For example, the jig pivot axis may be set at a distance 0.1 inches below the clamp axis (distance $D_1$ in FIG. 4). Such a distance will allow the material behind cutting edges 245 of a drill bit to be sloped rearward from the cutting edge at an angle of about 8° when the jig pivot axis is 0.7 inches from the face of the grindstone and about 12° when the jig pivot axis if 0.5 inches from the face of the grindstone. However, an offset $D_2$ of 0.07 inches will allow the material behind cutting edges 245 of a drill bit to be sloped backward about 8° when the pivot axis is 0.5 inches from the face of the grindstone and about 13° when the jig pivot axis is 0.3 inches from the face of the grindstone. It is beneficial to reduce the offset D when sharpening smaller diameter drill bits. The drill bit sharpening device can be adapted to sharpen small drill bits by using the bores 240 and 241 as pivot arms and a shaft such as shown in the arrangement of FIG. 3 at numeral 156 as a pivot arm support. When a larger drill bit needs to be sharpened, sleeves 238 and 239 are used as pivot arms and a sleeve arrangement such as shown in FIG. 5 is used as a pivot arm support. The sleeve 356 of bracket 357 is provided with an internal diameter larger than the external diameter of sleeves 238 and 239 to provide a sliding fit.

The above referenced embodiments can be conveniently and economically constructed of molded plastic or metal giving precise tolerance control. This will provide a very accurate drill bit sharpening device for both the experienced and inexperienced user.

I claim:

1. A drill bit sharpening device, for use with a support carrying a rotatable grindstone and having pivot arm retaining means, the device comprising a drill bit jit having:

(a) clamp means for releasably retaining a drill bit therein in a position wherein the drill bit extends forward from the clamp means along a corresponding clamp axis said clamp means having:

(i) a first and second opposed jaw movable toward and away from one another so as to accommodate different diameter drill bits positioned therebetween; and (ii) a jaw adjuster connected to said first jaw, having a U-shaped frame with upper and lower threaded flanges extending over said second jaw, retaining guide means connected to said second jaw, and a nut for fastening to said threaded flanges, said nut being positioned between said guide means and said second jaw, such that when tightened, said nut and flanges will move toward on another and said nut will but said second jaw to urge said second jaw against said drill bit and said first jaw, and when said nut is loosened, said nut and flanges will move away from one another and said nut will abut said retaining guide means to urge said second jaw away from said first one;

(b) a first and second jig pivot arm connected to said first and second jaw at one end thereof and symmetrically located about the axis of a drill bit such that if said clamp means is rotated 180° about its axis said arms will assume identical and diametrically opposed positions; and (c) said pivot arms being located such that the first pivot arm can rest on a pivot arm retaining means with the axis of the drill bit held in the clamp extending forward to intersect a grinding face of said grindstone carried in said support at a predetermined angle $A_1$ thereto, and in an inverted clamp position the second arm can rest on a pivot arm retaining means, with the axis of the drill bit held in the clamp extending forwardly to intersect the same grinding face at an identical point of intersection on the drill bit axis and at an equal angle $A_2$.

2. A drill bit sharpening device as defined in claim 1, wherein the jig pivot arms and the pivot arm retaining means, allow the jig to pivot about a jig pivot axis in a vertical direction perpendicular to the clamp axis, when the jig is in the first or second rest position.

3. A drill bit sharpening device as defined in claim 2 wherein the first and second jig pivot arms, comprise a first and second shaft disposed such that the lateral angle between the clamp axis and a first axis extending along said first shaft, is equal but opposite to the lateral angle between the clamp axis and a second axis extending along said second shaft, so that when the jig is in the first or second rest position, the first or second jig pivot arm rests on the same pivot arm retaining means.

4. A drill bit sharpening device as defined in claim 3, wherein said pivot arm retaining means, comprises a sleeve disposed on said support carrying a rotatable grindstone, such that an axis extending along said sleeve is parallel to the rotational axis of said grindstone allowing said jig to pivot about said sleeve when the jig is in the first or second rest position.

5. A drill bit sharpening device as defined in claim 4, wherein each flange of said jaw adjuster is provided with a guiding channel adapted to receive said retaining guide means.

6. A drill bit sharpening device as defined in claim 5, wherein said retaining guide means is comprised of a bracket having an upper and lower guiding arm, each adapted to be connected to a first and opposite side of said second jaw, said upper guiding arm providing a sliding fit in said guiding channel of said upper flange and said lower guiding arm providing a sliding fit in said guiding channel of said lower flange, said bracket having a first and second retaining tab, each tab extending laterally from said bracket, such that when tightened, said nut will abut against said second jaw to urge said first and second jaw toward one another and when loosened, said nut will abut against said first and second retaining tabs to urge said first and second jaw away from one another.

7. A drill bit sharpening device as defined in claim 6, wherein each of said first and second opposed jaw is elongated and provided with alternately sloping sets of symmetrical teeth which mesh to center said drill bit along said clamp axis.

8. A drill bit sharpening device as defined in claim 7, wherein said first and second opposed jaw is provided with a slanted face at said one end thereof such that the distance between the pivot arm axis and said rotatable grindstone is minimized.

9. A drill bit sharpening device as defined in claim 8, wherein said slanted face of said first and second jaw is parallel to said first and second pivot arm respectively.

10. A drill bit sharpening device as defined in claim 9, wherein the clamp axis is vertically spaced from the jig pivot axis, and wherein said support has a grindstone mount to rotatably support a circular grindstone at a grindstone axis laterally spaced from the jig pivot axis, so that a drill bit held in the clamp means can have each of its cutting edges sharpened at the same predetermined angle to the clamp axes, and the material behind its cutting edges sloped rearward from the cutting edges in a backsweep arc by pivoting the jig above the jig pivot axis.

11. A drill bit sharpening device as defined in claim 10, wherein the jig pivot arms and pivot arm retaining means are disposed so that each of the angles $A_1$ and $A_2$ are 59°, and wherein the angle between the clamp axes and the jig pivot axes are such that when a grindstone is supported in the grindstone mount, the material behind each cutting edge of a drill bit held in the clamp means can be cut in a rearward convex slope at a fixed angle of from substantially 8° to 12° adjacent the cutting edge in a rearward arc of substantially 0.7 inches radius, by pivoting said jig about said jig pivot axis.

12. A drill bit sharpening device as defined in claim 11, additionally comprising a circular grindstone supported in the grindstone mount.

13. A drill bit sharpening device as defined in claim 3, wherein said first and second pivot arm comprise a first and second sleeve disposed such that the lateral angle between the clamp axis and a first axis extending along said first sleeve is equal but opposite to the lateral angle between the clamp axis and a second axis extending along said second sleeve, so that when the jig is in the first or second rest position, the first or second jig pivot arm rests on the same pivot arm retaining means.

14. A drill bit sharpening device as defined in claim 13, wherein said pivot arm retaining means, comprises a shaft disposed on said support carrying a rotatable grindstone, such that an axis extending along said shaft is parallel to the rotational axis of said grindstone allowing said jig to pivot about said shaft when the jig is in the first or second rest position.

15. A drill bit sharpening device as defined in claim 13, wherein said first and second sleeve is each comprised of a bore having an axis eccentrically located in relation to the axis of the sleeve such that the vertical distance between the axes of said sleeve and said clamp means is equal to an offset $D_1$ and the vertical distance between the axes of said bore and said clamp means is equal to an offset $D_2$.

16. A drill bit sharpening device as defined in claim 15, wherein a support shaft is used as a pivot arm retaining means, when said bore is used as a jig pivot arm, and a support sleeve is used as a pivot arm retaining means when said sleeve of said clamp means is used as a jig pivot arm, said support sleeve having an interior diameter larger than the exterior diameter of said pivot arm sleeve.

17. A drill bit sharpening device as defined in claim 16, wherein each flange of said jaw adjuster is provided with a guiding channel adapted to receive said retaining guide means.

18. A drill bit sharpening device as defined in claim 17, wherein said retaining guide means is comprised of a bracket having an upper and lower guiding arm, each adapted to be connected to a first and opposite side of said second jaw, said upper guiding arm providing a sliding fit in said guiding channel of said upper flange and said lower guiding arm providing a sliding fit in said guiding channel of said lower flange, said bracket having a first and second retaining tab, each tab extending laterally from said bracket, such that when tightened, said nut will abut against said second jaw to urge said first and second jaw toward one another and when loosened, said nut will abut against said first and second retaining tabs to urge said first and second jaw away from one another.

19. A drill bit sharpening device as claimed in claim 18, wherein each of said first and second opposed jaw is elongated and provided with alternately sloping sets of symmetrical teeth which mesh to center said drill bit along said clamp axis.

20. A drill bit sharpening device as defined in claim 19, wherein said first and second opposed jaw is provided with a slanted face at said one end thereof such that the distance between the pivot arm axis and said rotatable grindstone is minimized.

21. A drill bit sharpening device as defined in claim 20, wherein said slanted face of said first and second jaw is parallel to said first and second pivot arm respectively.

22. A drill bit sharpening device as defined in claim 21, wherein said support has a grindstone mount to rotatably support a circular grindstone at a grindstone axis laterally spaced from the jig pivot axis, so that a drill held in the clamp means can have each of its cutting edges sharpened at the same predetermined angle to the clamp axes, and the material behind its cutting edges sloped rearward from the cutting edges in a backsweep arc by pivoting the jig above the jig pivot axis.

23. A drill bit sharpening device as defined in claim 22, wherein the jig pivot arms and pivot arm retaining means are disposed so that each of the angles $A_1$ and $A_2$ are 59°, and wherein the angle between the clamp axes and the jig pivot axes are such that when a grindstone is supported in the grindstone mount, the material behind each cutting edge of a drill bit held in the clamp means can be cut in a rearward convex slope at a fixed angle of from substantially 8° to 12° adjacent the cutting edge in a rearward arc of substantially 0.7 inches radius, by pivoting said jig about said jig pivot axis.

24. A drill bit sharpening device as defined in claim 23, additionally comprising a circular grindstone supported in the grindstone mount.

25. A drill bit sharpening device comprising:

(a) a support adapted to carry a rotatable grindstone, and having pivot arm retaining means; and (b) a drill bit jig having:

(i) clamp means for releasably retaining a drill bit therein in a position wherein the drill bit axis extends forward from the clamp means along a corresponding clamp axis, said clamp means having:

(1) a first and second opposed jaw movable toward and away from one another so as to accommodate different diameter drill bits positioned therebetween; and (2) a jaw adjuster connected to said first jaw, having a U-shaped frame with upper and lower threaded flanges extending over said second jaw, retaining guide means connected to said second jaw, and a nut for fastening to said threaded flanges, said nut being positioned between said guide means and said second jaw, such that when tightened, said nut and flanges will move toward on another and said nut will abut said second jaw to urge said second jaw against said drill bit and said first jaw, and when said nut is loosened, said nut and flanges will move away from one another and said nut will abut said retaining guide means to urge said second jaw away from said first one;

(ii) a first and second jig pivot arm connected to said first and second jaw at one end thereof and symmetrically located about the axis of a drill bit such that if said clamp means is rotated 180° about its axis said arms will assume identical and diametrically opposed positions; and (iii) said pivot arms being located such that the first pivot arm can rest on a pivot arm retaining means with the axis of the drill bit held in the clamp extending forward to intersect a grinding face of said grindstone carried in said support at a predetermined angle $A_1$ thereto, and in an inverted clamp position the second arm can rest on a pivot arm retaining means, with the axis of the drill bit held in the clamp extending forwardly to intersect the same grinding face at an identical point of intersection on the drill bit axis and at an equal angle $A_2$.

26. A drill bit sharpening device as defined in claim 25, wherein the jig pivot arms and the pivot arm retaining means, allow the jig to pivot about a jig pivot axis in a vertical direction perpendicular to the clamp axis, when the jig is in the first or second rest position.

27. A drill bit sharpening device as defined in claim 26 wherein the first and second jig pivot arms, comprise a first and second shaft disposed such that the lateral angle between the clamp axis and a first axis extending along said first shaft, is equal but opposite to the lateral angle between the clamp axis and a second axis extending along said second shaft, so that when the jig is in the first or second rest position, the first or second jig pivot arm rests on the same pivot arm retaining means.

28. A drill bit sharpening device as defined in claim 27, wherein said pivot arm retaining means, comprises a sleeve disposed on said support carrying a rotatable grindstone, such that an axis extending along said sleeve is parallel to the rotational axis of said grindstone allowing said jig to pivot about said sleeve when the jig is in the first or second rest position.

29. A drill bit sharpening device as defined in claim 28, wherein each flange of said jaw adjuster is provided with a guiding channel adapted to receive said retaining guide means.

30. A drill bit sharpening device as defined in claim 29, wherein said retaining guide means is comprised of a bracket having an upper and lower guiding arm, each adapted to be connected to a first and opposite side of said second jaw, said upper guiding arm providing a sliding fit in said guiding channel of said upper flange and said lower guiding arm providing a sliding fit in said guiding channel of said lower flange, said bracket having a first and second retaining tab, each tab extending laterally from said bracket, such that when tightened, said nut will abut against said second jaw to urge said first and second jaw toward one another and when loosened, said nut will abut against said first and second retaining tabs to urge said first and second jaw away from one another.

31. A drill bit sharpening device as defined in claim 30, wherein each of said first and second opposed jaw is elongated and provided with alternately sloping sets of symmetrical teeth which mesh to center said drill bit along said clamp axis.

32. A drill bit sharpening device as defined in claim 31, wherein said first and second opposed jaw is provided with a slanted face at said one end thereof such that the distance between the pivot arm axis and said rotatable grindstone is minimized.

33. A drill bit sharpening device as defined in claim 32, wherein said slanted face of said first and second jaw is parallel to said first and second pivot arm respectively.

34. A drill bit sharpening device as defined in claim 33, wherein the clamp axis is vertically spaced from the jig pivot axis, and wherein said support has a grindstone mount to rotatably support a circular grindstone at a grindstone axis laterally spaced from the jig pivot axis, so that a drill bit held in the clamp means can have each of its cutting edges sharpened at the same predetermined angle to the clamp axes, and the material behind its cutting edges sloped rearward from the cutting edges in a backsweep arc by pivoting the jig above the jig pivot axis.

35. A drill bit sharpening device as defined in claim 34, wherein the jig pivot arms and pivot arm retaining means are disposed so that each of the angles $A_1$ and $A_2$ are 50°, and wherein the angle between the clamp axes and the jig pivot axes are such that when a grindstone is supported in the grindstone mount, the material behind each cutting edge of a drill bit held in the clamp means can be cut in a rearward convex slope at a fixed angle of from substantially 8° to 12° adjacent the cutting edge in a rearward arc of substantially 0.7 inches radius, by pivoting said jig about said jig pivot axis.

36. A drill bit sharpening device as defined in claim 35, additionally comprising a circular grindstone supported in the grindstone mount.

37. A drill bit sharpening device as defined in claim 27, wherein said first and second pivot arm comprises a first and second sleeve disposed such that the lateral angle between the clamp axis and a first axis extending along said first sleeve is equal but opposite to the lateral angle between the clamp axis and a second axis extending along said second sleeve, so that when the jig is in the first or second rest position, the first or second jig pivot arm rests on the same pivot arm retaining means.

38. A drill bit sharpening device as defined in claim 37, wherein said pivot arm retaining means, comprises a shaft disposed on said support carrying a rotatable grindstone, such that an axis extending along said shaft is parallel to the rotational axis of said grindstone allowing said jig to pivot about said shaft when the jig is in the first or second rest position.

39. A drill bit sharpening device as defined in claim 37, wherein said first and second sleeve in each comprised of a bore having an axis eccentrically located in relation to the axis of the sleeve such that the vertical distance between the axes of said sleeve and said clamp means is equal to an offset $D_1$ and the vertical distance between the axes of said bore and said clamp means is equal to an offset $D_2$.

40. A drill bit sharpening device as defined in claim 39, wherein a support shaft is sued as a pivot arm retaining means, when said bore is used as a jig pivot arm, and a support sleeve is used as a pivot arm retaining means when said sleeve of said clamp means is used as a jig pivot arm, said support sleeve having an interior diameter larger than the exterior diameter of said pivot arm sleeve.

41. A drill bit sharpening device as defined in claim 40, wherein each flange of said jaw adjuster is provided with a guiding channel adapted to receive said retaining guide means.

42. A drill bit sharpening device as defined in claim 41, wherein said retaining guide means is comprised of a bracket having an upper and lower guiding arm, each adapted to be connected to a first and opposite side of said second jaw, said upper guiding arm providing a sliding fit in said guiding channel of said upper flange and said lower guiding arm providing a sliding fit in said guiding channel of said lower flange, said bracket having a first and second retaining tab, each tab extending laterally from said bracket, such that when tightened, said nut will abut against said second jaw to urge said first and second jaw toward one another and when loosened, said nut will abut against said first and second retaining tabs to urge said first and second jaw away from one another.

43. A drill bit sharpening device as defined in claim 42, wherein each of said first and second opposed jaw is elongated and provided with alternately sloping sets of symmetrical teeth which mesh to center said drill bit along said clamp axis.

44. A drill bit sharpening device as defined in claim 43, wherein said first and second opposed jaw is provided with a slanted face at said one end thereof such that the distance between the pivot arm axis and said rotatable grindstone is minimized.

45. A drill bit sharpening device as defined in claim 44, wherein said slanted face of said first and second jaw is parallel to said first and second pivot arm respectively.

46. A drill bit sharpening device as defined in claim 45, wherein said support has a grindstone mount to rotatably support a circular grindstone at a grindstone axis laterally spaced from the jig pivot axis, so that a drill bit held in the clamp means can have each of its cutting edges sharpened at the same predetermined angle to the clamp axes, and the material behind its cutting edge sloped rearward from the cutting edges in a backsweep arc by pivoting the jig above the jig pivot axis.

47. A drill bit sharpening device as defined in claim 46, wherein the jig pivot arms and pivot arm retaining means are disposed so that each of the angles $A_1$ and $A_2$ are 59°, and wherein the angle between the clamp axes of the jig pivot axes are such that when a grindstone is supported in the grindstone mount, the material behind each cutting edge of a drill bit held in the clamp means can be cut in a rearward convex slope at a fixed angle of from substantially 8° to 12° adjacent the cutting edge in a rearward arc of substantially 0.7 inches radius, by pivoting said jig about said jig pivot axis.

48. A drill bit sharpening device as defined in claim 47, additionally comprising a circular grindstone supported in the grindstone mount.

* * * * *